US010174990B2

(12) United States Patent
Park et al.

(10) Patent No.: US 10,174,990 B2
(45) Date of Patent: Jan. 8, 2019

(54) REFRIGERATOR

(71) Applicant: LG ELECTRONICS INC., Seoul (KR)

(72) Inventors: Junsoo Park, Seoul (KR); Jiyeong Ku, Seoul (KR); Jiyoon Lee, Seoul (KR); Jiyoung Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/540,665

(22) PCT Filed: Dec. 31, 2015

(86) PCT No.: PCT/KR2015/014539

§ 371 (c)(1),
(2) Date: Jun. 29, 2017

(87) PCT Pub. No.: WO2016/108652

PCT Pub. Date: Jul. 7, 2016

(65) Prior Publication Data

US 2017/0350638 A1 Dec. 7, 2017

(30) Foreign Application Priority Data

Dec. 31, 2014 (KR) ..... 10-2014-0195846

(51) Int. Cl.
*F25D 23/02* (2006.01)
*A47B 95/02* (2006.01)
*E05F 11/54* (2006.01)

(52) U.S. Cl.
CPC ..... *F25D 23/028* (2013.01); *A47B 95/02* (2013.01); *E05F 11/54* (2013.01)

(58) Field of Classification Search
CPC .. F25D 23/028; F25D 2323/02; Y10T 16/458; Y10T 16/498; Y10T 292/0993;
(Continued)

(56) References Cited

U.S. PATENT DOCUMENTS 3,586,810 A * 6/1971 Brown ..... H01H 13/06 200/302.2
5,988,709 A * 11/1999 Lee ..... E05B 65/0042 292/199
(Continued)

FOREIGN PATENT DOCUMENTS

DE 102012015412 A1 * 1/2014 ..... F25D 23/028
KR 10-0189102 6/1999
(Continued)

OTHER PUBLICATIONS

International Search Report and Written Opinion dated Apr. 6, 2016 issued in Application No. PCT/KR2015/014539 (Full English Text).

*Primary Examiner* — Andrew M Roersma
(74) *Attorney, Agent, or Firm* — KED & Associates, LLP

(57) ABSTRACT

The present invention includes a body having a storage compartment defined therein, a door for opening and closing the storage compartment, a lifting member, which includes a handle and a first gear extending in a vertical direction and which is disposed at the door in a manner of being movable upward and downward, a second gear, which is disposed at the door so as to engage with the first gear, a third gear, which is disposed at the door so as to engage with the second gear, and a pushing member, which is disposed at the door so as to be movable in forward and rearward directions and which includes a fourth gear engaging with the third gear, the pushing member exerting external force on the body when the lifting member is lowered, thereby offering an advantage in that a user such as a child, who is short, can easily open the door.

14 Claims, 9 Drawing Sheets

(58) Field of Classification Search
CPC ..... Y10T 292/1018; Y10T 292/11; Y10T 292/175; Y10T 292/18; E05B 65/0042; E05B 65/005; E05B 17/0033; E05B 17/0037; Y10S 292/12; Y10S 292/71
USPC ..... 49/276, 277, 278
See application file for complete search history.

(56) References Cited

U.S. PATENT DOCUMENTS

| | | | | |
|---|---|---|---|---|
| 8,523,302 | B2 * | 9/2013 | Shin | F25D 23/028 312/405 |
| 2011/0001414 | A1 * | 1/2011 | Jang | F25D 23/00 312/405 |
| 2011/0048060 | A1 * | 3/2011 | Kim | E05B 17/0029 62/449 |
| 2011/0083461 | A1 * | 4/2011 | Kim | F25D 23/028 62/264 |
| 2013/0026900 | A1 * | 1/2013 | Oh | F25D 23/02 312/401 |
| 2015/0176886 | A1 * | 6/2015 | Lee | E05C 7/02 312/404 |
| 2015/0260443 | A1 * | 9/2015 | Lee | F25D 23/02 312/404 |

FOREIGN PATENT DOCUMENTS

| | | | | | |
|---|---|---|---|---|---|
| KR | 10-0425733 | | | 4/2004 | |
| KR | 1020060055986 | A | * | 5/2006 | F25D 23/02 |
| KR | 10-2008-0050672 | | | 6/2008 | |
| KR | 10-2010-0081009 | | | 7/2010 | |
| KR | 1020100081009 | A | * | 7/2010 | F25D 23/02 |
| KR | 10-2011-0032900 | | | 3/2011 | |
| KR | 1020150019205 | A | * | 2/2015 | F25D 23/02 |
| WO | WO-2005057106 | A1 | * | 6/2005 | E05B 7/00 |
| WO | WO2007031418 | A1 | * | 3/2007 | F25D 23/02 |

* cited by examiner

[Fig. 1]
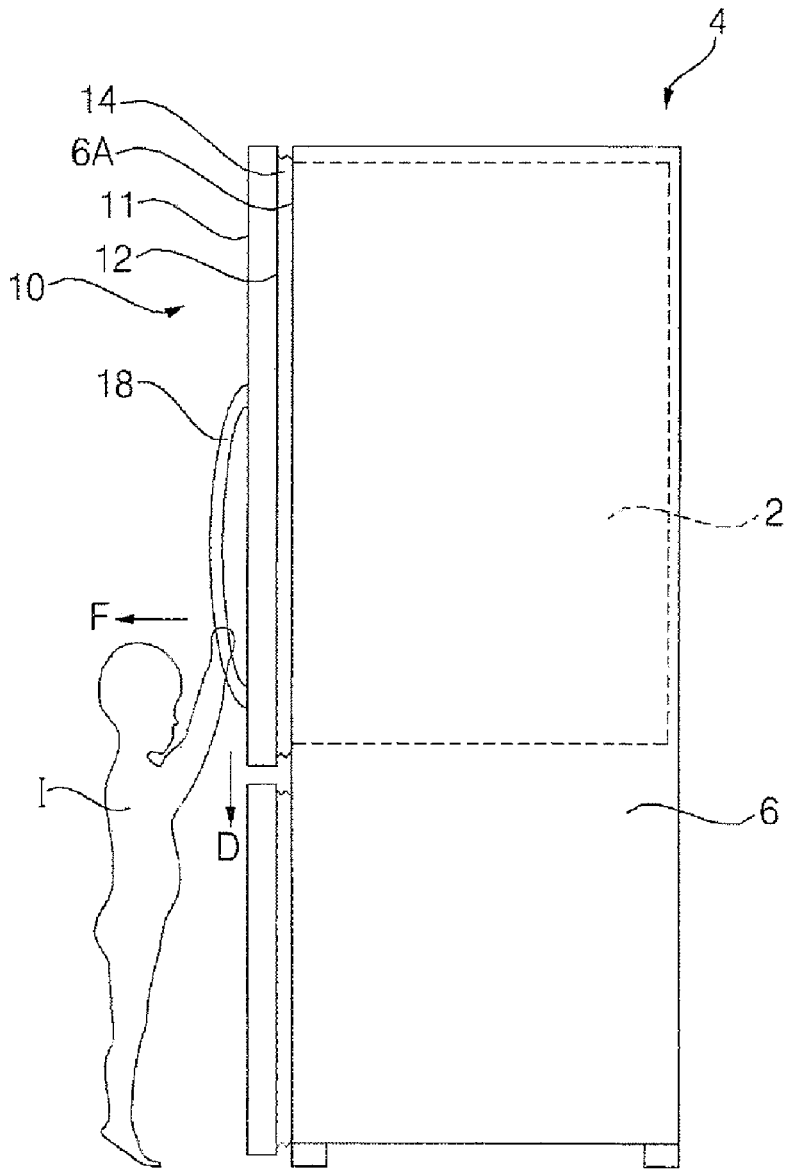

[Fig. 2]
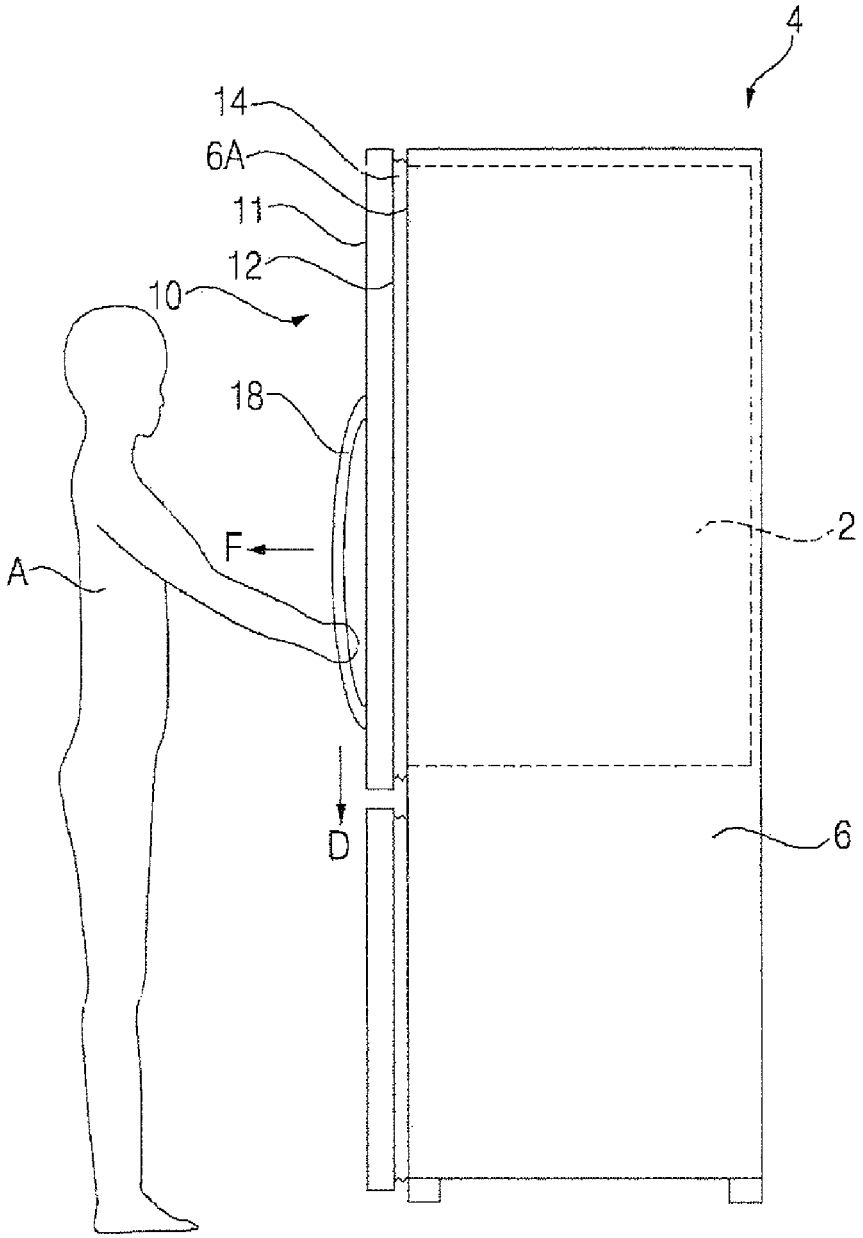

[Fig. 3]
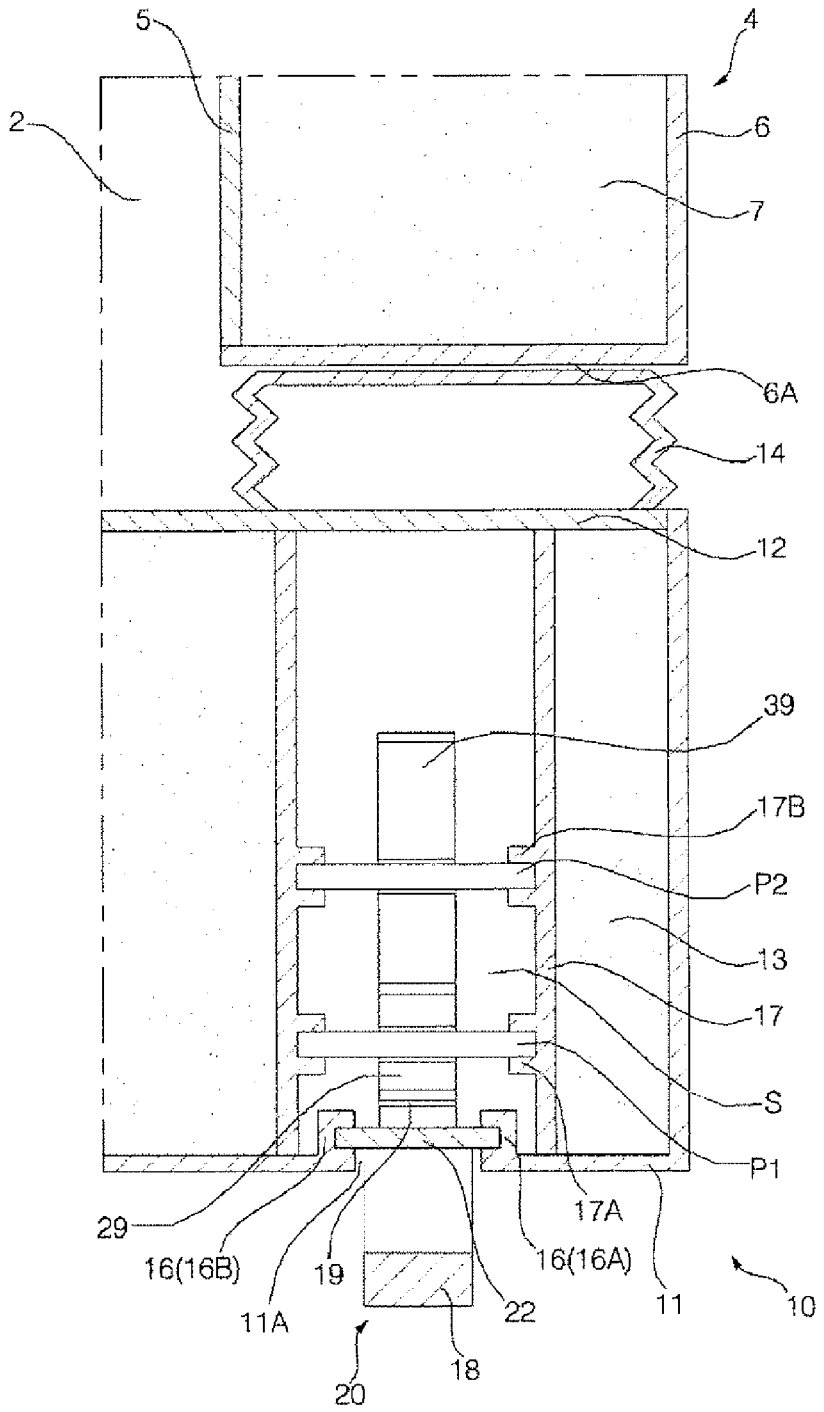

[Fig. 4]
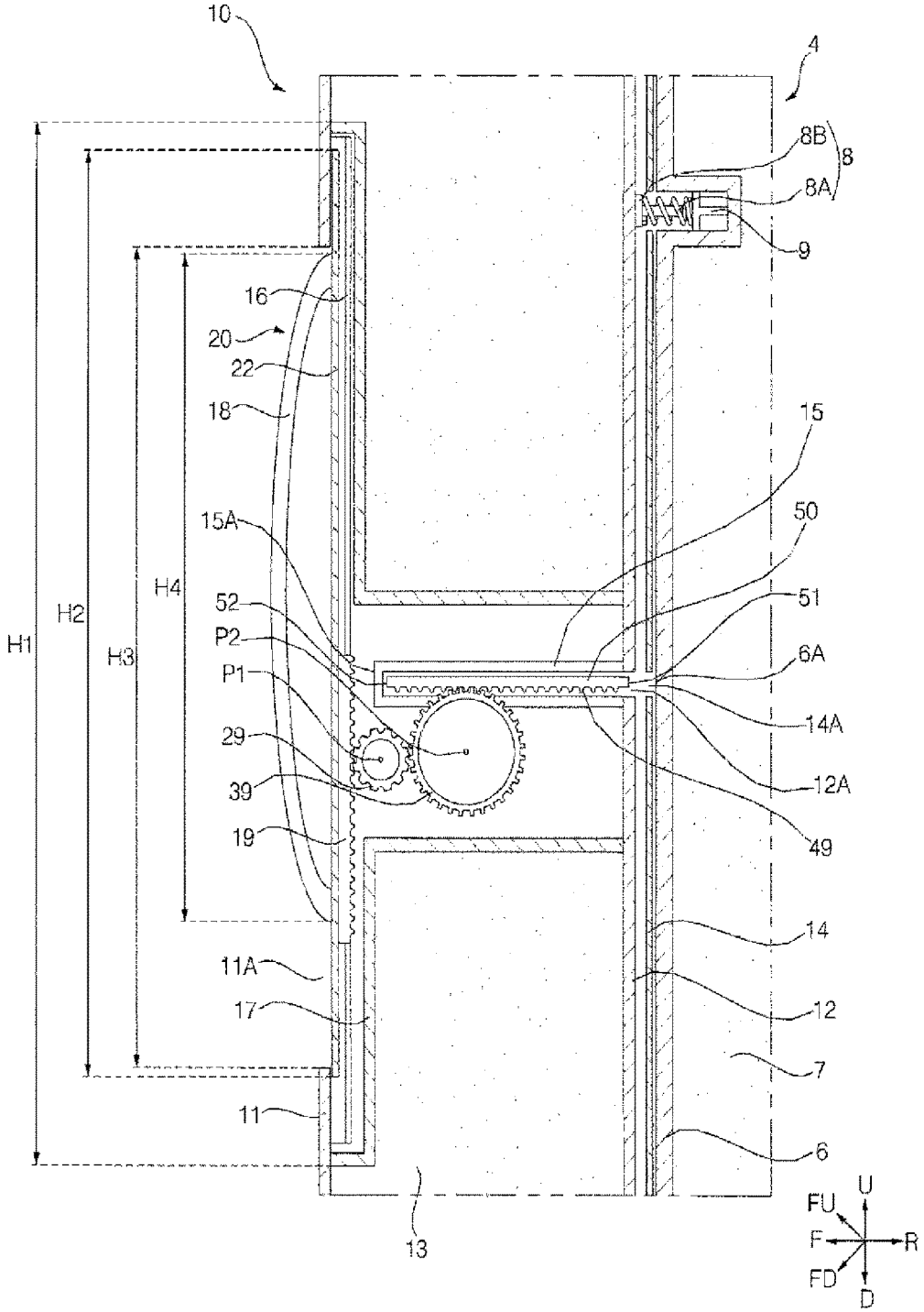

[Fig. 5]
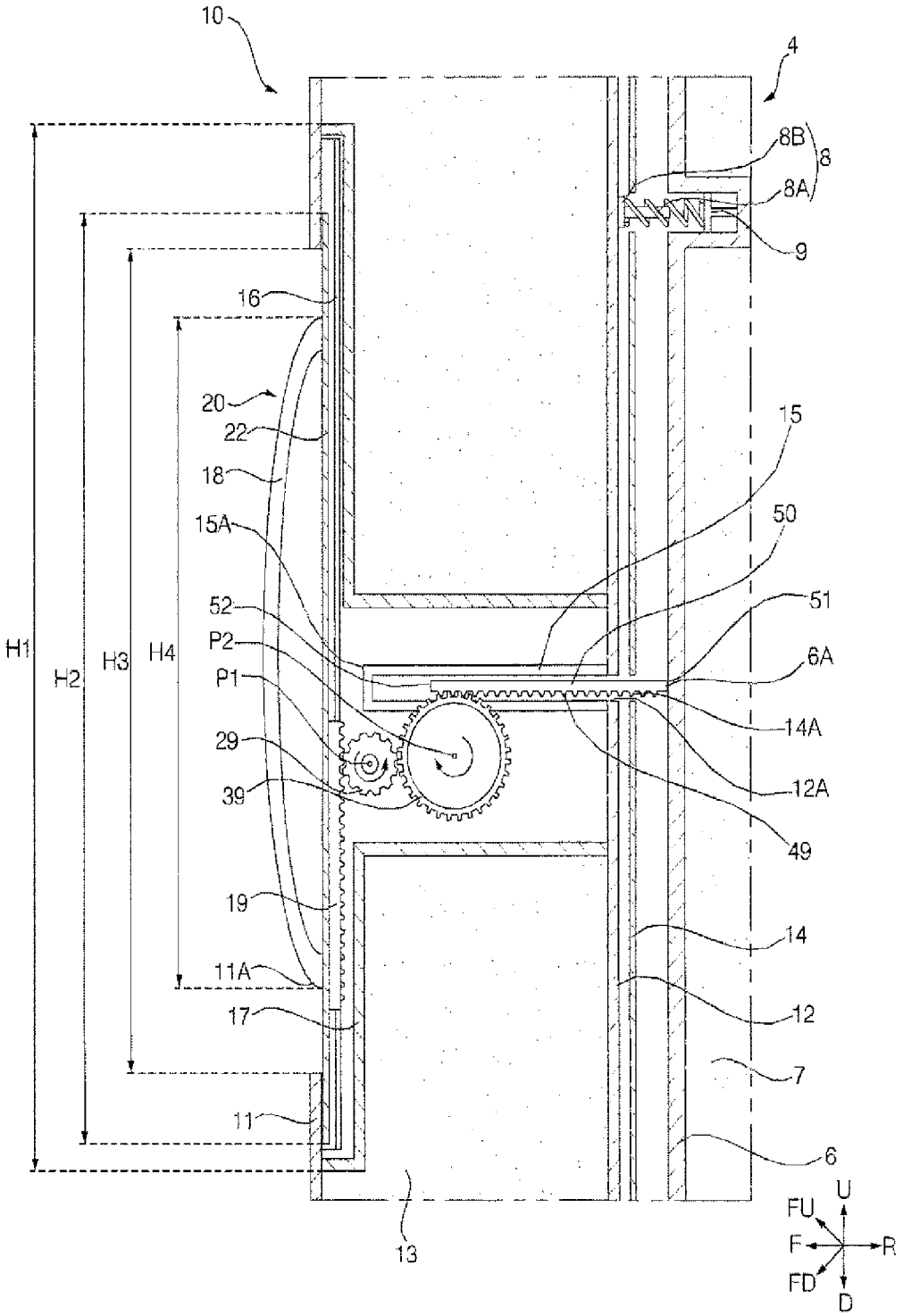

[Fig. 6]
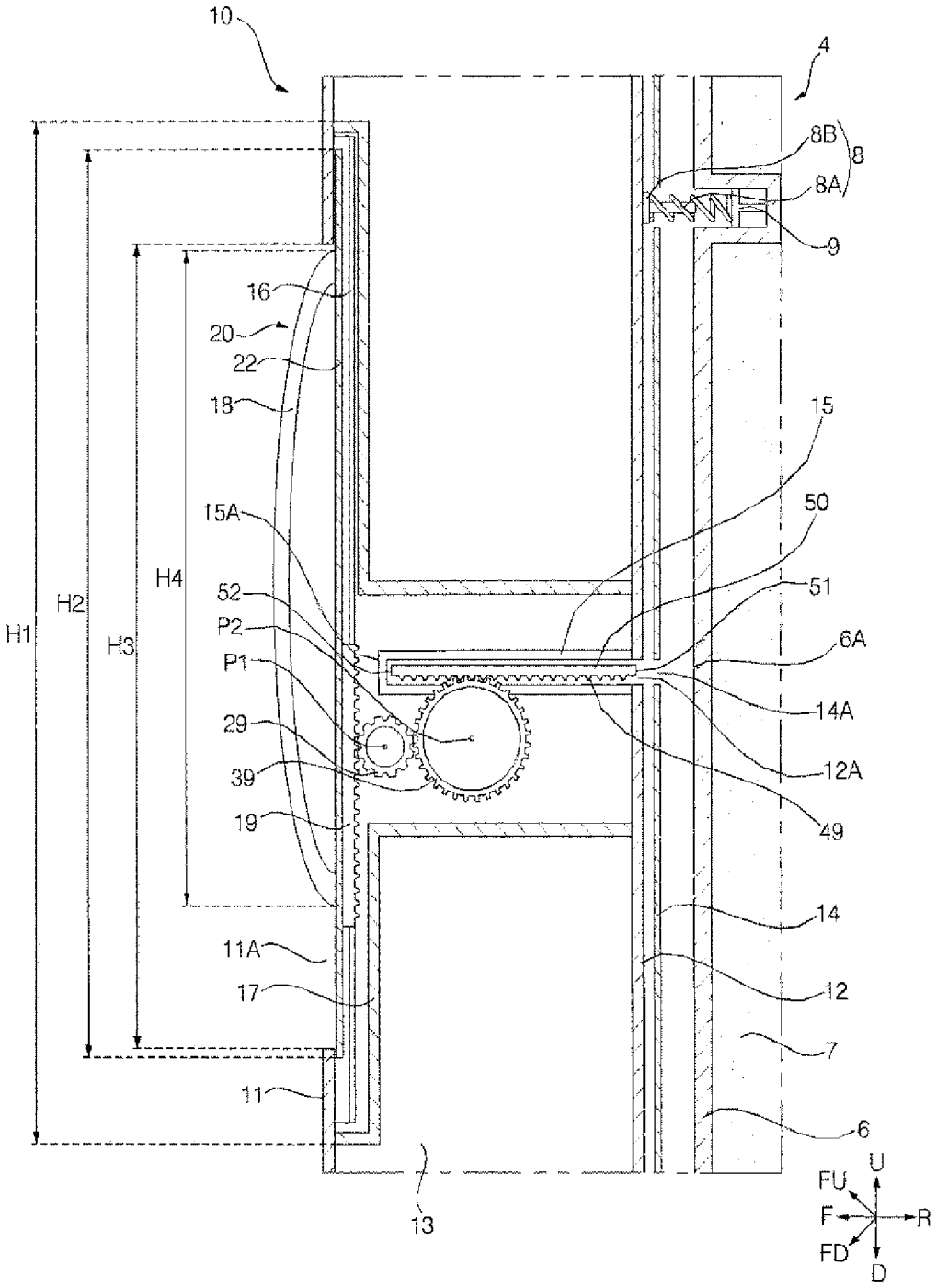

[Fig. 7]
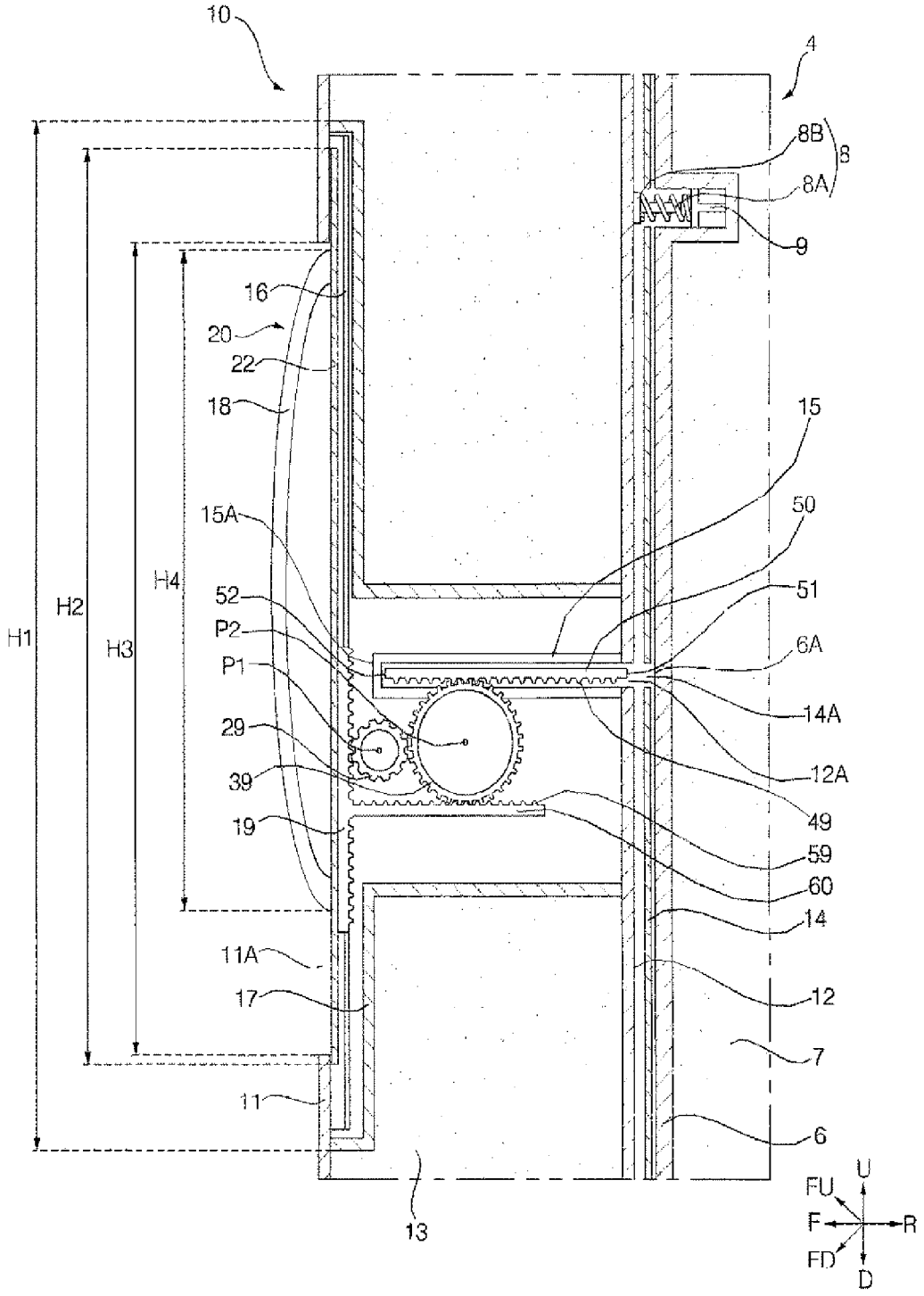

[Fig. 8]
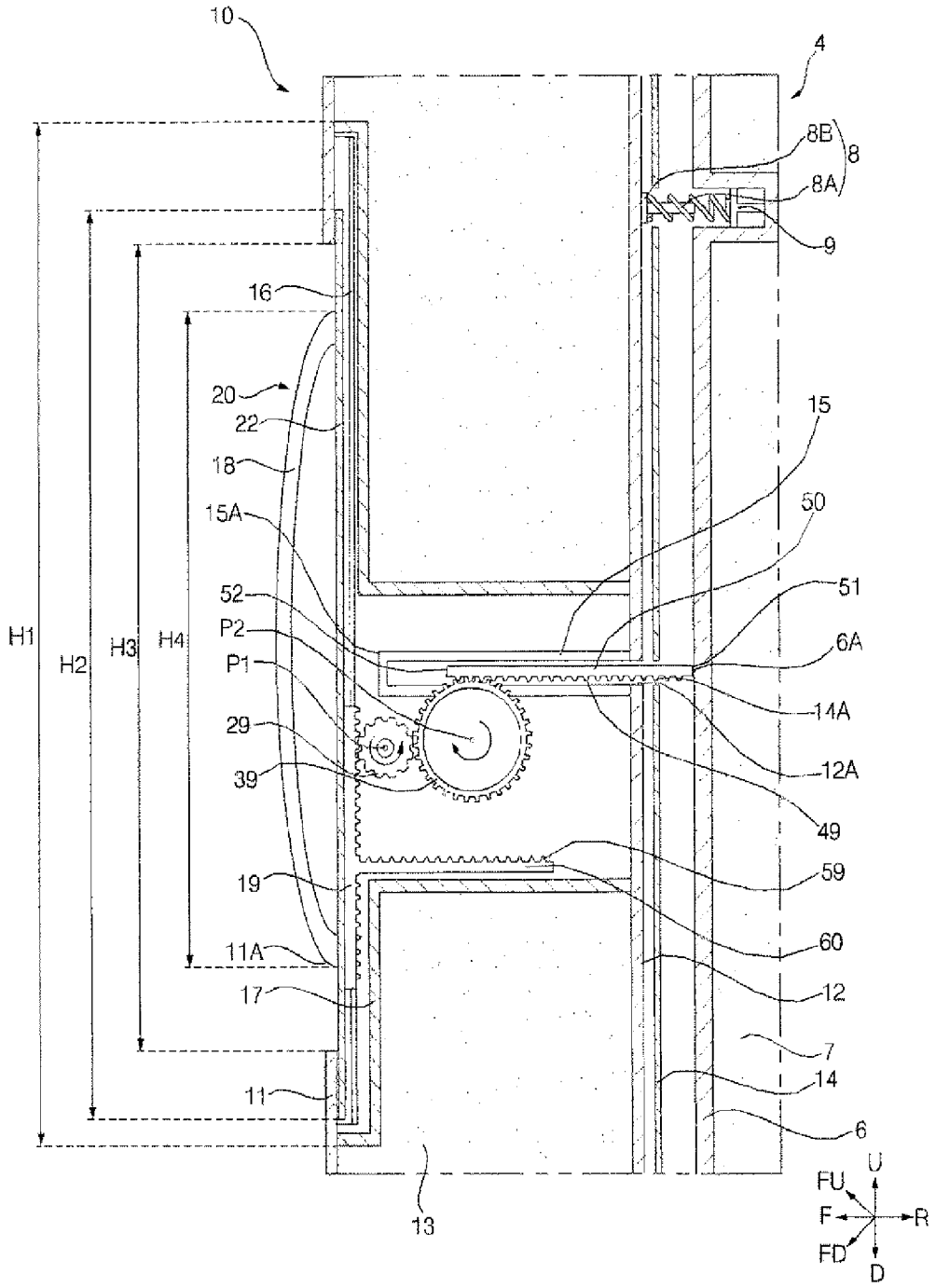

[Fig. 9]
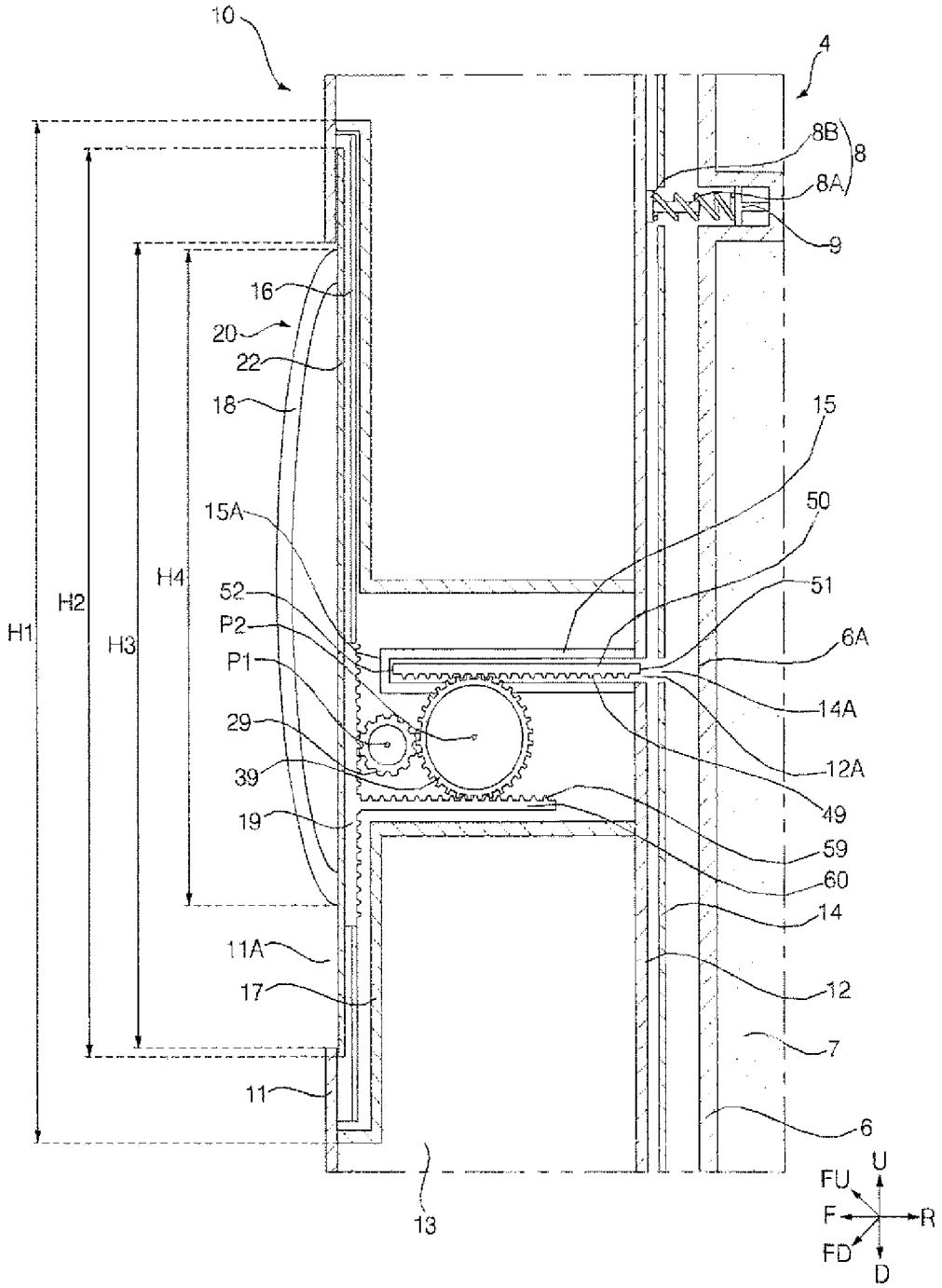

REFRIGERATOR

CROSS-REFERENCE TO RELATED PATENT APPLICATIONS

This application is a U.S. National Stage Application under 35 U.S.C. § 371 of PCT Application No. PCT/KR2015/014539, filed Dec. 31, 2015, which claims priority to Korean Patent Application No. 10-2014-0195846, filed Dec. 31, 2014, whose entire disclosures are hereby incorporated by reference.

TECHNICAL FIELD

The present invention relates to a refrigerator, and more particularly to a refrigerator in which a door is provided with a handle.

BACKGROUND ART

In general, a refrigerator is an appliance which is constructed to cool a storage compartment, such as a refrigerating compartment and a freezing compartment, by means of a refrigerating cycle circuit, a thermoelectric module or the like, and to store objects such as foodstuffs in the storage compartment.

The refrigerator may be provided with a door for opening and closing the storage compartment. The door may be opened in rightward and leftward directions about a vertical hinge shaft or may be opened in a vertical direction about a horizontal hinge shaft. The door may be provided with a handle, which may protrude or be recessed so as to be capable of being grasped by a user.

The door may be rotated about the hinge shaft so as to be opened in the forward direction of the storage compartment, and a user may rotate the door forward by grasping the handle and pulling the handle forward.

A short user such as a child may stretch his/her hand upward and may pull the door of the refrigerator while grasping the lower portion of the handle. In this case, since the horizontal component of the external force applied to the door may be relatively low, a short user such as a child may not be capable of easily opening the door.

DISCLOSURE OF INVENTION

Technical Problem

An object of the present invention is to provide a refrigerator which is constructed to enable a user to easily open a door by pulling a handle downward while grasping a handle.

Solution to Problem

In an aspect of the present invention, a refrigerator according to the present invention includes a body having a storage compartment defined therein, a door for opening and closing the storage compartment, a lifting member, which includes a handle and a first gear extending in the vertical direction and which is disposed at the door in a manner of being movable upward and downward, a second gear, which is disposed at the door so as to engage with the first gear, a third gear, which is disposed at the door so as to engage with the second gear, and a pushing member, which is disposed at the door so as to be movable in forward and rearward directions and which includes a fourth gear engaging with the third gear, the pushing member exerting external force on the body when the lifting member is lowered.

The fourth gear may be disposed on the third gear.

The door may include a lifting member guide, which serves to guide the upward and downward movement of the lifting member and to restrict the forward and rearward movement of the lifting member.

The door may have a blind hole through which the pushing member passes.

The door may include a pushing member guide for guiding the forward and rearward movement of the pushing member.

The pushing member may include a rear end, which serves as a contact end that either contacts the body or is separated from the body.

The third gear may be configured so as to be larger than the second gear.

The lifting member may further include a fifth gear, which extends in forward and rearward directions and engages with the third gear when the lifting member is in an upper position.

The fifth gear may be disposed so as to be perpendicular to the first gear and such that part thereof is positioned under the third gear.

The third gear may be disposed between the fourth gear and the fifth gear.

The fifth gear may be positioned to be parallel to the fourth gear.

The fifth gear may be separated from the third gear when the lifting member is lowered.

The refrigerator may further include an elastic unit, which is installed at the body so as to elastically bias the door in the direction in which the door is opened.

In another aspect of the present invention, a refrigerator includes a body having a storage compartment defined therein, a door for opening and closing the storage compartment, and a door pushing unit, which, pushes the door outward through the pushing member by a reaction force that opposes the external force applied to the door, when a handle is lowered.

The door pushing unit comprises a interlocking unit and a pushing member 50.

The interlocking unit may include a lifting member including a handle, and an external force transmitting unit for moving the pushing member forward or rearward upon the vertical movement of the lifting member.

The external force transmitting unit may include a first gear, which is disposed at the lifting member so as to extend in the vertical direction, a second gear, which is disposed at the door so as to engage with the first gear, a third gear, which is disposed at the door so as to engage with the second gear, and a fourth gear, which is formed at the pushing member so as to extend in a forward and rearward direction.

The door may include a lifting member guide for guiding the upward and downward movement of the lifting member and restricting the forward and rearward movement of the lifting member.

The lifting member may further include a fifth gear, which extends in forward and rearward directions and engages with the third gear when the lifting member is in an upper position.

The fifth gear may be disposed so as to be perpendicular to the first gear and such that part thereof is positioned under the third gear.

In a further aspect of the present invention, a refrigerator includes a body having a storage compartment defined therein, a door for opening and closing the storage compartment, a handle, which is movably disposed at the door, a pushing member, which is disposed at the door in a manner of being movable in a forward and rearward direction, and an interlocking unit for connecting the handle to the pushing member, wherein, when the handle is lowered, the pushing member is moved rearward by the interlocking unit, whereby the door is pushed outward through the pushing member by reaction force that opposes the external force that is applied to the door.

Advantageous Effects of Invention

The refrigerator according to the present invention offers an advantage in that a door is pushed forward through a pushing member by virtue of a reaction force that opposes the force applied to a body upon the downward movement of a handle, thereby enabling the door to be easily opened, and even a user such as a child, who is short, can easily open the door by pulling the handle downward while grasping the handle.

Furthermore, the refrigerator according to the present invention offers an advantage in that, since the height of a handle can be lowered, a user such as a child, who is short, can pull the handle in the horizontal direction or in a direction close to the horizontal direction and can thus easily open a door.

In addition, a user can select an action of pulling a handle while lowering the handle or an action of pulling the handle only in the forward direction, thereby providing convenience in opening a door.

Furthermore, the refrigerator according to the present invention offers an advantage in that, since a higher reaction force can be created by virtue of second gear and third gear which serve as reduction gears, it is possible to open a door even by using a relatively small force.

BRIEF DESCRIPTION OF DRAWINGS

FIG. 1 is a side view showing a refrigerator according to an embodiment of the present invention in which a handle is pulled downward;

FIG. 2 is a side view showing the refrigerator according to the embodiment of the present invention in which the handle is pulled forward;

FIG. 3 is a transverse cross-sectional view showing the door shown in FIG. 1;

FIG. 4 is an enlarged longitudinal cross-sectional view showing the door shown in FIG. 1, which is closed;

FIG. 5 is an enlarged longitudinal cross-sectional view showing the door shown in FIG. 4, in which the handle is lowered;

FIG. 6 is an enlarged longitudinal cross-sectional view showing the door shown in FIG. 2, in which the handle shown is pulled forward;

FIG. 7 is an enlarged longitudinal cross-sectional view showing the door of a refrigerator according to another embodiment of the present invention in a closed state;

FIG. 8 is an enlarged longitudinal cross-sectional view showing the door of the refrigerator shown in FIG. 7, in which a handle is lowered; and FIG. 9 is an enlarged longitudinal cross-sectional view showing the door of the refrigerator shown in FIG. 7, in which a handle is pulled forward.

BEST MODE FOR CARRYING OUT THE INVENTION

Relative spatial terms such as "below," "beneath," "lower," "above," or "upper" may be used herein to describe one element's relationship to another element as illustrated in the drawings. It will be understood that relative spatial terms are intended to encompass different orientations of the elements during the use or operation of the elements in addition to the orientation depicted in the drawings. For example, if the elements in one of the drawings are turned over, elements described as "below" or "beneath" other elements would then be oriented "above" the other elements. The exemplary terms "below" or "beneath" can, therefore, encompass both the orientations "above" and "below". Since the elements may be oriented in another direction, the relative spatial terms may be interpreted in accordance with the orientation of the elements.

The terminology used in this specification is for the purpose of describing particular embodiments only, and is not intended to limit the present invention. As used in this specification, singular forms are intended to include the plural forms as well, unless the context clearly indicates otherwise. It will be further understood that the terms "comprises" and/or "comprising," when used in this specification, specify the presence of stated elements, steps, and/or operations, but do not preclude the presence or addition of one or more other elements, steps, and/or operations.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having meanings that are consistent with their meanings in the context of the relevant art and the present disclosure, and will not be interpreted in an idealized or overly formal sense unless expressly so defined herein.

In the drawings, the thickness or size of each element is exaggerated, omitted, or schematically illustrated for convenience of description and clarity. Also, the size or area of each element does not necessarily accurately reflect the actual size thereof.

In addition, angles or directions used to describe the structures of embodiments of the present invention are based on those shown in the drawings. Unless there is, in this specification, no definition of a reference point to describe angular positional relationships in the structures of embodiments of the present invention, the associated drawings may be referred to.

Hereinafter, an embodiment of the present will be described in detail with reference to the accompanying drawings.

FIGS. 1 to 6 are views showing a refrigerator according to the present invention.

The refrigerator may include a body 4 including a storage compartment 2 defined therein, and a door 10 for opening and closing the storage compartment 2. The refrigerator may include a push unit in which, when a handle 18 is lowered, a pushing member 50 is retracted by an interlocking unit and the door 10 is pushed out through the pushing member 50 by a reaction force that opposes the force which is applied to the door 10.

The handle 18 may be movably provided on the door 10.

The pushing member 50 may be disposed in the door so as to be movable back and forth.

The interlocking unit, which serves to transmit the external force that is applied to the handle 18 to the pushing member 50, may connect the handle 18 to the pushing member 50. The interlocking unit may include a lifting member 20 equipped with the handle 18 and external force transmitting units 19, 29, 39 and 49, which serve collectively to move the pushing member 50 forward or rearward upon the vertical movement of the lifting member 20.

The external force transmitting unit 19, 29, 39 and 49 may include a first gear 19, which is formed at the lifting member 20 so as to be vertically elongated, a second gear 29, which is disposed at the door 10 and engages with the first gear 19, a third gear 30, which is disposed at the door 10 and engages with the second gear 29, and a fourth gear 49, which is formed at the pushing member 50 so as to be enlongated in the forward and rearward directions.

The refrigerator may include the lifting member 20, which is provided with the handle 18, is liftably disposed on the door 10, and includes the first gear 19, which is vertically elongated; the second gear 29, which is disposed at the door 10 and engage with the first gear 19, the third gear, which is disposed at the door 10 and engages with the second gear 29, and the pushing member 50, which is disposed at the door 10 so as to be movable forward and rearward and includes the fourth gear 49 engaging with the third gear 35 and which exerts an external force on the body 4 upon the downward movement of the lifting member 20.

The body 4 may include at least one storage compartment 2 and an inner case 5 defining the storage compartment 2 therein. The body 4 may include an outer case 6 defining the appearance of the refrigerator, and the space between the outer case 6 and the inner case 5 may be filled with a thermal insulator 7. The body 4 may include a refrigeration cycle apparatus constituted by a compressor, a condenser, an expansion unit and an evaporator, and the evaporator may cool the storage compartment 2. The body 4 may further include a cooling fan for circulating the air in the storage compartment between the evaporator and the storage compartment 2. The body 4 may further include a condensation fan for blowing air to the condenser.

The body 4 may include a front surface 6A, which faces the door 10 when the door 10 is closed. The front surface 6A of the body 4 may be a close-contact surface, which faces the back surface of the door 10 and comes into close contact with the door 10 when the door 10 is closed.

As shown in FIGS. 4 to 6, the refrigerator may further include an elastic unit 8, which is installed at the body 4 so as to bias the door 10 in the direction in which the door 10 is opened. The elastic unit 8 may be installed at the body 4 so as to face the back surface of the door 10. The body 4 may be provided with an elastic unit holder 9 for supporting the elastic unit 8. The elastic unit 8 may include a spring member 8A, which is connected to the elastic unit holder 10, and a contact plate 8B, which is connected to the spring member 8A and is able to come into contact with the door 10 or to be separated from the door 10. The spring member 8A may be constituted by a coil spring or the like. The spring member 8A may be compressed by the contact plate 8B in the state of being received in the elastic member holder 9 and connected to the contact plate 8B. When the door 10 is opened, the spring member 8A may push the contact plate 8B toward the door 10 while expanding by its own elastic restoring force, and the door 10 may thus be easily rotated forward by the pushing force of the contact plate 8B.

The door 10 may include an outer door 11, a door liner 12, at least a portion of which faces the storage compartment 2, and a thermal insulator 13 disposed between the outer door 11 and the door liner 12. When the door 10 is closed, the outer door 11 may define the front appearance of the door 10, and the door liner 12 may define the back surface of the door 10 and may face a portion of the storage compartment 2. The door 10 may further include a gasket 14, which is disposed on the door liner 12 and is in close contact with the front surface 6A of the body 4.

The door 10 may have therein a blind hole 12A through which the pushing member 50 extends. The blind hole 12A may be configured such that part of the pushing member 50 protrudes toward the body 4. The blind hole 12A may be formed in the back surface of the door 10, which faces the body 4. The blind hole 12A may be formed through the door liner 12. The blind hole 12A may be formed at a location in the door 10 that does not face the storage compartment 2, but faces the front surface 6A of the body 4. The blind hole 12A may have a larger sectional area than the pushing member 50.

The gasket 14 may have formed therein a pushing member blind hole 14A, through which the pushing member 50 extends so as to contact the front surface 6A of the body 4.

The door 10 may include a pushing member guide 15 for guiding the back-and-forth movement of the pushing member 50. The pushing member guide 15 may guide the forward and rearward linear movement of the pushing member 50. The pushing member guide 15 may be disposed at at least one of the door liner 12 and a gear box 17, which will be described later, so as to extend toward the outer door 11.

The pushing member guide 15 may be provided with a stopper 15A for restricting excessive forward movement of the pushing member 50. When the handle 18 is positioned at the upper limit, the forward end of the pushing member 50 may come into contact with the stopper 15A, whereby excessive forward movement of the pushing member 50 may be restricted.

The pushing member guide 15 may be configured to guide at least one of the upper, lower, right and left surfaces of the pushing member 50. The pushing member guide 15 may be configured so as to allow the pushing member 50 to extend thereinto, and may be configured to have a hollow cylindrical shape. The pushing member guide 15 may be provided at the front end with the stopper 15A.

The pushing member guide 15 may be configured so as to guide the lateral side surfaces of the pushing member 50. The pushing member guide 15 may be configured to be recessed into or to protrude from the gear box 17. The pushing member guide 15 may include a pair of ribs for guiding the lateral side surfaces of the pushing member 50, whereby the lateral side surfaces of the pushing member 50 may slide along the pair of ribs in the forward and rearward directions. When the pushing member guide 15 includes the pair of ribs, the pushing member guide 15 may further include a front end connector connecting the pair of ribs. The front end connector of the pushing member guide 15 may be the stopper 15A.

The door 10 may include a lifting member guide 16 for guiding the lifting member 20 in the vertical direction. The lifting member guide 16 may restrict the forward and rearward (FR) movement of the lifting member 20. The lifting member guide 16 may be provided at the door 10 in the upward and downward (UD) direction. The lifting member 20 may be inserted partway into the lifting member guide 16 and may slide in the vertical direction along the lifting member guide 20. The lifting member guide 16 may be provided at the outer door 11 in the state of extending in the vertical direction. The lifting member guide 16 may be configured to have a "U"-shaped cross section.

The lifting member guide 16 may include a left guide 16A for guiding the left part of the lifting member 20 and a right guide 16B for guiding the right part of the lifting member 20.

The left guide 16A may have a sliding rail on the surface thereof that faces the right guide 16B, and the right guide 16B may have a sliding rail on the surface thereof that faces the left guide 16A.

The door 10 may further include the gear box 17 which accommodates the first gear 19, the second gear 29 and the third gear 39. The fourth gear 49 may be partially or completely accommodated in the gear box 17. The gear box 17 may be positioned between the outer door 11 and the door liner 12. The door 10 may be filled with a thermal insulator 13 between the gear box 17 and the outer door 11. The thermal insulator 13 may surround the outer surface of the gear box 17. The gear box 17 may be coupled to at least one of the outer door 11 and the door liner 12. The gear box 17 may be larger than the lifting member 20. The gear box 17 may have a height H1 greater than the height H2 of the lifting member 20.

The door 10 may further include a second gear support 17A for rotatably supporting the second gear 29 and a third gear support 17B for rotatably supporting the third gear 39. The gear box 17 may have an open front face. The gear box 17 may have an open rear face. The gear box 17 may be configured to have a box shape defining therein an accommodation space S in which at least some of the first gear 19, the second gear 29, the third gear 39 and the fourth gear 49 are accommodated.

The lifting member 20 may be provided on the rear surface thereof with the first gear 19, and the lifting member guide 16 may include a lifting plate 22 which is slidably guided. The handle 18 may be provided on the front surface of the lifting plate 22.

The handle 18 may be formed on the lifting plate 22 so as to protrude forward. The handle 18 may be coupled at the upper and lower ends thereof to the lifting plate 22, and may protrude forward from the lifting plate 22.

The first gear 19 may be constituted by a rack which is provided on the back surface of the lifting plate 22 in the vertical direction. The first gear 19 may be constituted by a vertical rack which is provided on the back surface of the lifting plate 22. The first gear 19 may be formed on the back surface of the lifting plate 22 so as to protrude toward the door liner 12. When a user grasps the handle 18 and pulls the handle 18 downward, the first gear 19 may be lowered downward together with the lifting plate 22.

The door 10 may be provided with an opening 11A, within which the handle 18 is lifted and lowered. The handle 18 may be disposed through the opening 11A, and may be lifted and lowered in the opening 11A. The height H3 of the opening 11A may be greater than the height H4 of the handle 18. The height H3 of the opening 11A may be less than the height H2 of the lifting plate 22. The height H2 of the lifting plate 22 may be the same as the height H2 of the lifting member 20, and thus the heights are designated by the same symbol.

The opening 11A may be covered by the lifting plate 22. Part of the lifting plate 22 may be positioned behind the opening 11A, regardless of whether the lifting plate 20 is lifted or lowered, such that the interior behind the door 10 is not visible through the opening 11A.

As shown in FIG. 3, the left part of the lifting plate 22 may be fitted into the left guide 16A so as to be lifted and lowered by the left guide 16A, and the right part of the lifting plate 22 may be fitted into the right guide 16B so as to be lifted and lowered by the right guide 16B.

The second gear 29, the third gear 39 and the fourth gear 49 according to the present invention may be a plurality of power transmission members for converting the upward and downward movement of the lifting member 20 into the forward and rearward movement of the pushing member 50.

The second gear 29 may be positioned behind the lifting member 20. The second gear 29 may be rotated by the first gear 19 when the lifting member 20 is lowered, and may be rotated in the opposite direction by the first gear 19 when the lifting member 20 is lifted. The second gear 29 may be embodied as a first pinion which engages with the first gear 19. The second gear 29 may be rotated in forward and reverse directions about the rotating shaft P1. The rotating shaft P1 of the second gear 29 may be rotatably coupled to the door 10. The rotating shaft P1 of the second gear 29 may be rotatably coupled to the gear box 17 and may be supported thereby. The forward rotation of the second gear box 29 may be the clockwise rotation of the second gear 29, and the reverse rotation of the second gear 29 may be the counterclockwise rotation of the second gear 29.

The third gear 39 may be installed behind the lifting member 20. The third gear 39 may be installed behind the lifting member 20 with a space therebetween. When the second gear 29 is rotated, the third gear 39 may be rotated by the second gear 29, thereby moving the fourth gear 49 forward and rearward. When the fourth gear 49 is rotated, the third gear 39 may be rotated by the fourth gear 49, thereby rotating the second gear 29.

The second gear 29 and the third gear 39 may be embodied as spur gears. The third gear 39 may be configured to be larger than the second gear 29. When the second gear 29 is smaller than the third gear 39, the second gear 29 and the third gear 39 may serve as reduction gears. In this case, although the rotational speed of the third gear 39 is lower than the second gear 29, the third gear 39 may transmit power that increases in inverse proportion to the rotational speed thereof.

The third gear 39 may be rotated about the rotating shaft P2 in forward and reverse directions. The rotating shaft P2 of the third gear 39 may be rotatably coupled to the door 10. The rotating shaft P2 of the third gear 39 may be rotatably coupled to the gear box 17 and may be supported thereby. The forward rotation of the third gear 39 may be the clockwise rotation of the third gear 39, and the reverse rotation of the third gear 39 may be the counterclockwise rotation of the third gear 39. The third gear 39 may be rotated in the direction opposite to the rotational direction of the second gear 29. When the second gear 29 is rotated clockwise, the third gear 39 may be rotated counter-clockwise. When the second gear 29 is rotated counterclockwise, the third gear 39 may be rotated clockwise.

If the third gear 39 is not provided in the refrigerator and the fourth gear 49 directly engages with the second gear 29, the pushing member 50 may be moved forward upon the downward movement of the lifting member 20.

Meanwhile, when the third gear 39 is disposed between the second gear 29 and the fourth gear 49 so as to cause the second gear 29 and the fourth gear 49 to be rotated in opposite directions, the third gear 39 may move the pushing member 50 rearward upon downward movement of the lifting member 20.

The third gear 39 may serve as an idle gear which is disposed between the second gear 29 and the fourth gear 49 so as to change the rotational direction of the second gear 29 and to transmit the rotational force of the second gear 29 to the fourth gear 49.

The fourth gear 49 may be disposed on the third gear 39 so as to be moved forward or rearward. The fourth gear 49 may be embodied as a rack which extends in the direction in which the pushing member 50 is moved. The fourth gear 49 may be embodied as a horizontal rack which is formed on the lower surface of the pushing member 50 in forward and rearward directions. The third gear 39 may be constituted by the second pinion gear, which engage with the fourth gear 49.

The pushing member 50 may be disposed so as to contact the body 4 or to be separated from the body 4. When the lifting member 20 is lowered, the pushing member 50 may be moved toward the body 40, thereby exerting external force on the front surface of the body 4. When the handle 18 is lowered, the pushing member 50 may be moved rearward toward the front surface 6A of the body 4, whereby the pushing member 50 contacts the front surface 6A of the body 4 and exerts force on the front surface 6A of the body 4. When the lifting member 20 is lifted, the pushing member 20 may be moved forward, and may thus be separated from the body 4.

The pushing member 50 may be constituted by a horizontal bar which is horizontally disposed in the door 10. The pushing member 50 may be configured such that the contact end 51, which contacts the body 4 is provided at the rear end thereof. The front end of the pushing member 50 may be the free end, which is oriented toward the lifting member 22, and the rear end of the pushing member 50 may be the contact end 51 which contacts the body 4 or is separated from the body 4.

Hereinafter, the operation of the present invention, constructed as described above, will be described.

As shown in FIG. 1, when a user I such as a child, who is short, (hereinafter, referred to as a child) grasps and pulls the handle 18 in the downward direction (D), the lifting plate 22 may be lowered together with the handle 18, as shown in FIG. 5. At this time, the first gear 19 may be lowered together with the lifting plate 220. When the first gear 19 is lowered, the second gear 29 may be rotated counterclockwise whereas the third gear 39 may be rotated clockwise. As a result, the fourth gear 49 may be moved in the rearward direction (R). When the fourth gear 49 is moved rearward, the pushing member 50 may be linearly moved in the rearward direction (R), thereby exerting force on the front surface 6A of the body 4 in the rearward direction. Accordingly, the force caused by the reaction force of the body 4 is applied to the pushing member 50 and the door 10. At this time, the door 10 is pushed in the forward direction (F) and begins to open gradually, and the gasket 14 begins to be separated from the front surface 6A of the door 4.

When the door 10 begins to open in this way, the elastic unit 8 may push the door 10, thereby assisting in the opening of the door 10.

As a result, the door can be opened with less force than in the case in which the pushing member 50 does not exert force on the body, whereby the child I is able to easily open the door 10.

Consequently, the handle 18 may be positioned at a lower level than before the child I pulls the handle 18 in the downward direction (D). At this time, since the handle 18 is lowered, the child I can pull the handle 18 in the horizontal forward direction (F) or in a downward inclined direction (FD), which is between the horizontal direction and the vertical direction. In other words, the child I can more easily open the door 10 than in the case in which the child I pulls the handle 18 which is normally at a higher position.

A user A such as an adult, who is tall (hereinafter, referred to as an adult), can also open the door 10 in a manner of pulling the handle 18 in the downward direction (D) and then opening the door 10 as in the case of the child. As shown in FIGS. 2 and 6, an adult A can pull the handle 18 in the horizontal forward direction (F) or in an upward inclined direction (FU). In this case, the force applied to the lifting plate 22 through the handle 18 may be specifically exerted on the outer door 11, and the door 10 may begin to open by the force exerted by the adult A.

When the door 10 begins to open, the elastic unit 8 may assist in opening the door 10 by virtue of its own restoring force.

In other words, according to the present invention, both the child I and the adult A can easily open the door 20 in such a way as for the adult A to selectively execute an action of pulling the handle 18 forward while pulling the handle 18 in the downward direction (D) or an action of merely pulling the handle 18 in the forward direction (D).

FIGS. 7 to 9 are views showing a refrigerator according to an embodiment of the present invention.

A lifting member 20' according to this embodiment further includes a fifth gear 59, which extends in the forward and rearward directions.

The lifting member 20' may be moved between an upper position at which the handle 18 is lifted such that the pushing member 50 no longer exerts force on the front surface 6A of the body 4, and a lower position, at which the handle 18 is lowered such that the pushing member 50 exerts force on the front surface 6A of the body 4.

When the lifting member 20' is in the upper position, the fifth gear 59 may engage with the third gear 39. The presence of the lifting member 20' in the upper position means that the lifting member 20' has been eccentrically moved upward in the lifting member guide 16, as shown in FIG. 7. In contrast, the presence of the lifting member 20' in the lower position means that the lifting member 20' has been eccentrically moved downward in the lifting member guide 16, as shown in FIG. 8.

In this embodiment, since the body 4, the first gear 19, the second gear 29, the third gear 39, the fourth gear 49 and the like, other than the lifting member 20' and the fifth gear 59, are identical or similar to those in the previous embodiment, the components are designated by the same numerals, and a description of the construction and operation of these components is omitted.

The third gear 39 may be disposed between the fifth gear 49 and the fifth gear 59.

The fifth gear 59 may be perpendicular to the first gear 19, and may be positioned under the third gear 39. The fifth gear 59 may be formed on a projection 60 which projects from the back surface of the lifting plate 22 toward the door liner 12. The fifth gear 59 may be constituted by a rack gear which is formed on the projection 60 in the forward and rearward directions. The fifth gear 59 may be disposed to be parallel to the fourth gear 49. The fifth gear 59 and the fourth gear 49 may be disposed so as to face each other with respect to the third gear 39.

When the lifting member 20' is in the upper position, the fifth gear 59 may engage with the third gear 39 and may be maintained in the engaged state, as shown in FIG. 7. When the lifting member 20' is moved from the upper position to the lower position, the fifth gear 59 may be separated from the third gear 39, as shown in FIG. 8. When the door 10 is pulled in the forward direction (F), the fifth gear 59 may engage with the third gear 39, and may be maintained in the engaged state, as shown in FIG. 9.

As shown in FIGS. 7 and 9, when the fifth gear 59 becomes engaged with the third gear 39, the fifth gear 59 cannot be moved in the upward direction (U) due to the interference with the third gear 39, whereby excessive upward movement of the lifting member 20' can be restricted. In other words, the fifth gear 59 may serve as an upper-limit stopper for restricting the excessive upward movement of the lifting member 20.

As shown in FIG. 8, when the fifth gear 59 is spaced apart from the third gear 39, the fifth gear 59 cannot be moved any further in the downward direction (D) due to interference with the gear box 17, whereby excessive downward movement of the lifting member 20' can be restricted. In other words, the fifth gear 59 may serve as a lower limit stopper for restricting excessive downward movement of the lifting member 20.

It will be appreciated that the present invention is not limited to the above embodiments and various modifications of the present invention are possible, without departing from the scope and spirit of the invention.

The invention claimed is:

1. A refrigerator comprising:

a body having a storage compartment defined therein;

a door for opening and closing the storage compartment;

a lifting member, which includes a handle and a first gear extending in a vertical direction and which is disposed at the door in a manner of being movable upward and downward;

a second gear, which is disposed at the door so as to engage with the first gear;

a third gear, which is disposed at the door so as to engage with the second gear; and a pushing member, which is disposed at the door so as to be movable in forward and rearward directions and which includes a fourth gear engaging with the third gear, the pushing member exerting external force on the body when the lifting member is lowered, wherein the lifting member further includes a fifth gear, which extends in forward and rearward directions and engages with the third gear when the lifting member is in an upper position.

2. The refrigerator according to claim 1, wherein the fourth gear is disposed on the third gear.

3. The refrigerator according to claim 1, wherein the door includes a lifting member guide, which serves to guide upward and downward movement of the lifting member and to restrict forward and rearward movement of the lifting member.

4. The refrigerator according to claim 1, wherein the door has a blind hole through which the pushing member passes.

5. The refrigerator according to claim 1, wherein the door includes a pushing member guide for guiding forward and rearward movement of the pushing member.

6. The refrigerator according to claim 1, wherein the pushing member includes a rear end, which serves as a contact end that either contacts the body or is separated from the body.

7. The refrigerator according to claim 1, wherein the third gear is configured to be larger than the second gear.

8. The refrigerator according to claim 1, wherein the fifth gear is disposed so as to be perpendicular to the first gear and such that a portion thereof is positioned under the third gear.

9. The refrigerator according to claim 8, wherein the third gear is disposed between the fourth gear and the fifth gear.

10. The refrigerator according to claim 8, wherein the fifth gear is positioned to be parallel to the fourth gear.

11. The refrigerator according to claim 8, wherein the fifth gear is separated from the third gear when the lifting member is lowered.

12. The refrigerator according to claim 1, further comprising an elastic unit, which is installed at the body so as to elastically bias the door in a direction in which the door is opened.

13. A refrigerator comprising:

a body having a storage compartment defined therein;

a door for opening and closing the storage compartment; and a door pushing unit, which pushes the door outward by reaction force that opposes an external force that is applied to the door, when a handle is lowered, wherein the door pushing unit comprises an interlocking unit and a pushing member, the interlocking unit having:

a lifting member including a handle; and an external force transmitting unit for moving the pushing member forward or rearward upon vertical movement of the lifting member, the external force transmitting unit including:

a first gear provided at the lifting member so as to extend in a vertical direction, a second gear provided at the door so as to engage with the first gear;

a third gear provided at the door so as to engage with the second gear; and a fourth gear is formed at the pushing member so as to extend in a forward and rearward direction, wherein the door includes a lifting member guide for guiding upward and downward movement of the lifting member and restricting forward and rearward movement of the lifting member, and wherein the lifting member further includes a fifth gear, which extends in forward and rearward directions and engages with the third gear when the lifting member is in an upper position.

14. The refrigerator according to claim 13, wherein the fifth gear is disposed so as to be perpendicular to the first gear and such that a portion thereof is positioned under the third gear.

* * * * *